US010028050B2

(12) United States Patent
Han

(10) Patent No.: US 10,028,050 B2
(45) Date of Patent: Jul. 17, 2018

(54) SPEAKER DEVICE AND ELECTRONIC DEVICE INCLUDING THE SAME

(71) Applicant: Samsung Electronics Co., Ltd., Suwon-si, Gyeonggi-do (KR)

(72) Inventor: Ki-Wook Han, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/285,690

(22) Filed: Oct. 5, 2016

(65) Prior Publication Data

US 2017/0142513 A1 May 18, 2017

(30) Foreign Application Priority Data

Nov. 17, 2015 (KR) ..... 10-2015-0161290

(51) Int. Cl.

| | |
|---|---|
| ***H04R 1/02*** | (2006.01) |
| ***H04R 1/22*** | (2006.01) |
| ***H04R 1/28*** | (2006.01) |
| ***H04R 1/32*** | (2006.01) |

(52) U.S. Cl.

CPC ..... *H04R 1/227* (2013.01); *H04R 1/2811* (2013.01); *H04R 1/2834* (2013.01); *H04R 1/323* (2013.01); *H04R 1/023* (2013.01); *H04R 2499/11* (2013.01)

(58) Field of Classification Search

CPC .... H04R 2205/022; H04R 1/023; H04R 1/24; H04R 1/26; H04R 1/38; H04R 1/323; H04R 1/2834; H04R 1/227

USPC ..... 381/184, 186, 335, 342, 347, 348, 357

See application file for complete search history.

(56) References Cited

U.S. PATENT DOCUMENTS

| | | | | |
|---|---|---|---|---|
| 4,322,578 | A * | 3/1982 | Selmin | H04R 1/345 181/175 |
| 5,525,767 | A * | 6/1996 | Fields | H04R 1/342 181/145 |
| 6,910,549 | B2 * | 6/2005 | Kung | G06F 1/181 181/148 |
| 2006/0078144 | A1 * | 4/2006 | Stiles | H04R 1/02 381/335 |
| 2012/0033826 | A1 * | 2/2012 | Kakumoto | H04R 1/28 381/86 |
| 2013/0044909 | A1 | 2/2013 | Jeffery | |
| 2013/0170686 | A1 * | 7/2013 | Lester, Jr. | H04R 1/2803 381/338 |

(Continued)

*Primary Examiner* — William A Jerez Lora
(74) *Attorney, Agent, or Firm* — Jefferson IP Law, LLP

(57) ABSTRACT

A speaker device and an electronic device including the speaker device are provided. The electronic device includes a housing including an inner space and at least one through hole formed in a first direction, at least one speaker disposed in the inner space, directed toward the at least one through hole, a first structure disposed in the inner space, directed in a second direction different from the first direction, for vibrating along with vibration of the speaker generated when the speaker outputs first sound, and forming a first sound passage together with a part of the housing, and a second structure disposed in the inner space, directed in a third direction different from the first and second directions, for vibrating along with vibration of the speaker generated when the speaker outputs the first sound, and forming a second sound passage together with another part of the housing.

17 Claims, 8 Drawing Sheets

(56) References Cited

U.S. PATENT DOCUMENTS

| | | | | |
|---|---|---|---|---|
| 2013/0223667 | A1* | 8/2013 | Kim | H04R 1/2842<br>381/333 |
| 2013/0236031 | A1* | 9/2013 | Risberg | H04R 1/24<br>381/98 |
| 2014/0169605 | A1* | 6/2014 | Tinaphong | H04R 1/028<br>381/334 |
| 2016/0227315 | A1* | 8/2016 | Kim | H04R 1/2819 |
| 2017/0053633 | A1* | 2/2017 | Ishida | G10K 11/172 |

* cited by examiner

SPEAKER DEVICE AND ELECTRONIC DEVICE INCLUDING THE SAME

CROSS-REFERENCE TO RELATED APPLICATION(S)

This application claims the benefit under 35 U.S.C. § 119(a) of a Korean patent application filed on Nov. 17, 2015 in the Korean Intellectual Property Office and assigned Serial number 10-2015-0161290, the entire disclosure of which is hereby incorporated by reference.

TECHNICAL FIELD

The present disclosure relates to an electronic device. More particularly, the present disclosure relates to a speaker device and an electronic device including the same.

BACKGROUND

In general, an electronic device is a device that executes a specific function according to a loaded program, such as a home appliance, an electronic note, a portable multimedia player (PMP), a mobile communication terminal, a tablet personal computer (PC), a video/audio device, a desktop/laptop computer, an in-vehicle navigator, and the like. For example, these electronic devices may output stored information visually or audibly. Along with an increase in the integration level of the electronic devices and the increasing popularity of ultra-high-speed, large-capacity wireless communication, various functions are currently being loaded in a single mobile communication terminal. For example, an entertainment function such as gaming, a multimedia function such as music/video play, a communication and security function for mobile banking, a scheduling function, and an electronic wallet function as well as a communication function have been integrated in a single electronic device.

When the entertainment function and the multimedia function are used, the video quality and sound quality of an output of an electronic device may be a criteria for users' satisfaction. The video quality may be ensured through a large-screen, high-resolution display panel, and the sound quality may be ensured through a speaker having uniform output power in a low frequency band.

A small-sized electronic device such as a mobile communication terminal may have limitations in improving video quality and sound quality. For example, as a sound space gets narrow, sound may be weakened in the low frequency band of the audible frequency band. For example, because a sufficient sound space (e.g., a physical space and/or a mechanical space) is required to reinforce low-frequency-band sound, it may be very difficult to improve the sound quality of the small-sized electronic device. As an alternative, a speaker device connectable to the electronic device wirelessly and/or by cable may be used.

The speaker device may include a passive speaker having a heavy diaphragm to generate sound in the low frequency band. However, the speaker device may be vibrated by vibration of the passive speaker that generates sound, thereby disturbing music listening or video viewing. Although the vibration of the speaker may be mitigated by making the passive speaker less heavy, the low-frequency-band sound may be weakened.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a speaker device for improving sound quality by outputting sufficient sound in a low frequency band, and an electronic device including the speaker device.

Another aspect of the present disclosure is to provide a lightweight speaker device for mitigating vibration of the speaker device caused by vibration of a passive speaker, and an electronic device including the speaker device.

In accordance with an aspect of the present disclosure, an electronic device is provided. The electronic device includes a housing including an inner space and at least one through hole formed in a first direction, at least one speaker disposed in the inner space, directed toward the at least one through hole, a first structure disposed in the inner space, directed in a second direction different from the first direction, and configured to vibrate along with vibration of the speaker generated when the speaker outputs first sound, and forming a first sound passage together with a part of the housing, and a second structure disposed in the inner space, directed in a third direction different from the first direction and the second direction, and configured to vibrate along with vibration of the speaker generated when the speaker outputs the first sound, and forming a second sound passage together with another part of the housing. Each of the first sound passage and the second sound passage communicates with an outside of the housing in a direction different from the first direction.

In accordance with another aspect of the present disclosure, a speaker device is provided. The speaker device includes a housing forming an inner space, a first speaker mounted in the housing, configured to receive a sound signal, and generate a first sound in a first direction, a second speaker mounted in the housing, configured to generate a second sound in a second direction by vibrating according to a change in pressure of the inner space caused by operation of the first speaker, and a third speaker mounted in the housing, configured to generate a third sound in a third direction by vibrating according to the change in the pressure of the inner space caused by the operation of the first speaker. The second speaker and the third speaker are mounted opposite to each other.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
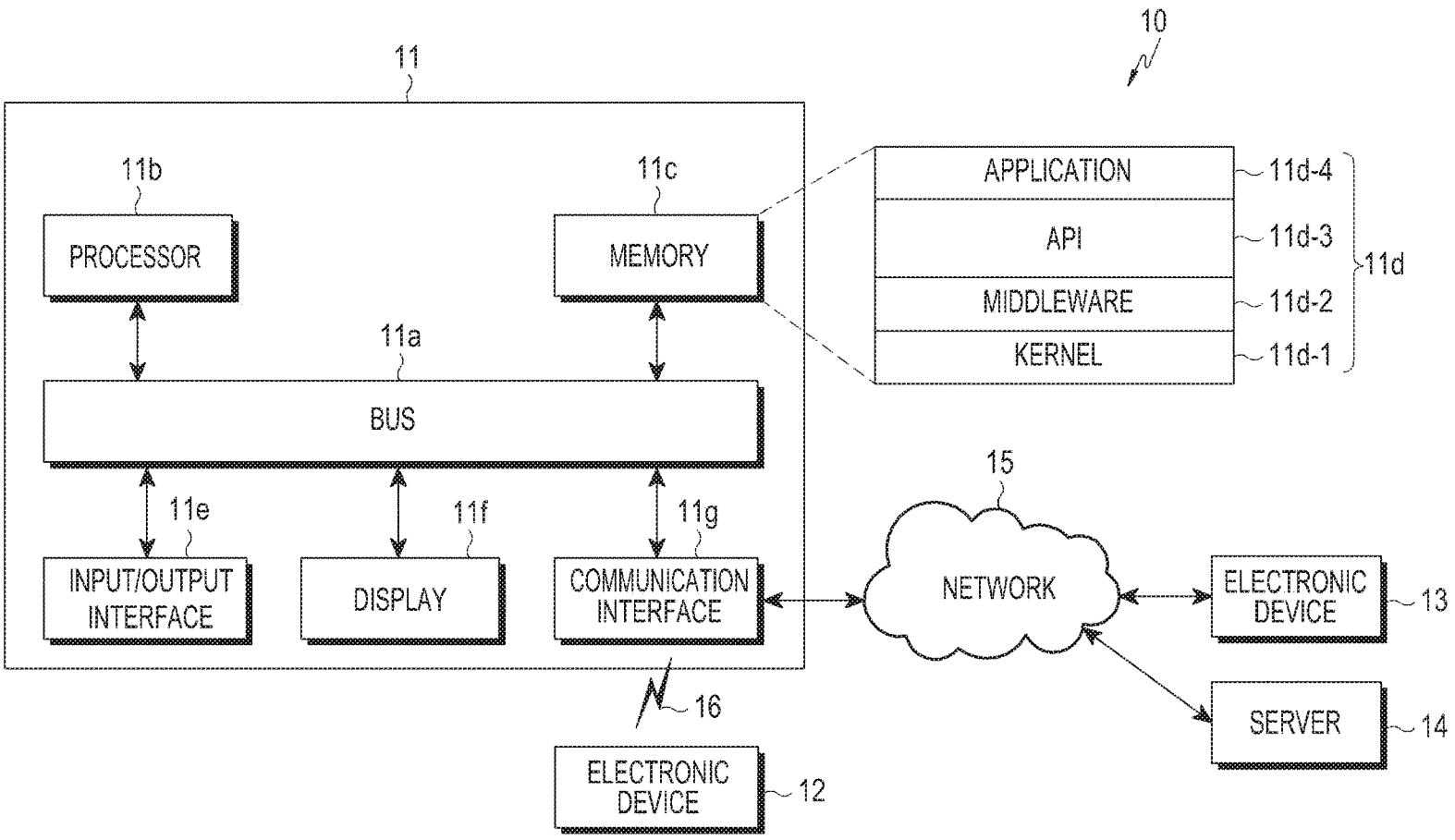
FIG. 1 is a block diagram of a network environment including an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In various embodiments of the present disclosure, the term 'A or B', 'at least one of A or/and B', or 'one or more of A or/and B' may cover all possible combinations of enumerated items. For example, 'A or B', 'at least one of A and B', or 'at least one of A or B' may represent all of the cases of (1) inclusion of at least one A, (2) inclusion of at least one B, and (3) inclusion of at least one A and at least one B.

The term as used in the present disclosure, 'first' or 'second' may modify the names of various components irrespective of sequence and/or importance, not limiting the components. These expressions may be used to distinguish one component from another component. For example, a first user equipment (UE) and a second UE may indicate different UEs irrespective of sequence or importance. For example, a first component may be referred to as a second component and vice versa without departing the scope of the present disclosure.

When it is said that a component (e.g., a first component) is 'operatively or communicatively coupled with/to' or 'connected to' another component (e.g., a second component), it should be understood that the one component is connected to the other component directly or through any other component (e.g., a third component). On the other hand, when it is said that a component (e.g., a first component) is 'directly connected to' or 'directly coupled to' another component (e.g., a second component), it may be understood that there is no other component (e.g., a third component) between the components.

The term 'configured to' as used herein may be replaced with, for example, the term 'suitable for' 'having the capacity to', 'designed to', 'adapted to', 'made to', or 'capable of' under circumstances. The term 'configured to' may not necessarily mean 'specifically designed to' in hardware. Instead, the term 'configured to' may mean that a device may mean 'capable of' with another device or part. For example, 'a processor configured to execute A, B, and C' may mean a dedicated processor (e.g., an embedded processor) for performing the corresponding operations or a generic-purpose processor (e.g., a central processing unit (CPU) or an application processor (AP)) for performing the corresponding operations.

The terms as used in the present disclosure are provided to describe merely specific embodiments, not intended to limit the scope of other embodiments. In the present disclosure, the term 'have', 'may have', 'include', or 'may include' signifies the presence of a specific feature, number, operation, component, or part, or their combination, not excluding the presence or addition of one or more other features, numbers, operations, components, or parts, or a combination thereof.

Unless otherwise defined, the terms and words including technical or scientific terms used in the following description and claims may have the same meanings as generally understood by those skilled in the art. The terms as generally defined in dictionaries may be interpreted as having the same or similar meanings as or to contextual meanings of related technology. Unless otherwise defined, the terms should not be interpreted as ideally or excessively formal meanings. When needed, even the terms as defined in the present disclosure may not be interpreted as excluding embodiments of the present disclosure.

In the present disclosure, an electronic device may be any device having a touch panel. An electronic device may be referred to as a terminal, a portable terminal, a mobile terminal, a communication terminal, a portable communication terminal, a display device, or the like.

For example, an electronic device may be a smartphone, a portable phone, a navigation device, a television (TV), an in-vehicle head unit, a laptop computer, a tablet computer, a portable multimedia player (PMP), a personal digital assistant (PDA), or the like. An electronic device may be configured as a pocket-sized portable communication terminal having wireless communication functionality. Further, an electronic device may be a flexible device or a flexible display device.

The electronic device may communicate with an external electronic device such as a server or perform a task through interaction with an external electronic device. For example, the electronic device may transmit an image captured by a camera and/or location information detected by a sensor unit to a server through a network. The network may be, but not limited to, a mobile or cellular communication network, a local area network (LAN), a wireless LAN (WLAN), a wide area network (WAN), the Internet, a small area network (SAN), or the like.

FIG. 1 is a block diagram of a network environment including an electronic device according to various embodiments of the present disclosure.

Referring to FIG. 1, an electronic device 11 in a network environment 10 according to various embodiments is described. The electronic device 11 may include a bus 11*a*, a processor 11*b*, a memory 11*c*, an input/output (I/O) interface 11*e*, a display 11*f*, and a communication interface 11*g*. In some embodiments, at least one of the components may be omitted in the electronic device 11 or a component may be added to the electronic device 11.

The bus 11*a* may include a circuit that interconnects, for example, the foregoing components 11*a*, 11*b*, 11 *c*, 11*e*, 11*f* and 11*g* and allows communication (e.g., control messages and/or data) between the foregoing components 11*a*, 11*b*, 11*c*, 11*e*, 11*f* and 11*g*.

The processor 11*b* may include one or more of a CPU, an AP, and a communication processor (CP). The processor 11*b* may, for example, execute computation or data processing related to control and/or communication of at least one other component of the electronic device 11.

The memory 11*c* may include a volatile memory and/or a non-volatile memory. The memory 11*c* may, for example, store instructions or data related to at least one other component. According to an embodiment, the memory 11*c* may store software and/or programs 11*d*. The programs 11*d* may include, for example, a kernel 11*d*-1, middleware 11*d*-2, an application programming interface (API) 11*d*-3, and/or application programs (or applications) 11*d*-4. At least a part of the kernel 11*d*-1, the middleware 11*d*-2, and the API 11*d*-3 may be called an operating system (OS).

The kernel 11*d*-1 may control or manage system resources (e.g., the bus 11*a*, the processor 11*b*, and the memory 11*c*) that are used in executing operations or functions implemented in other programs such as the middleware 11*d*-2, the API 11*d*-3, or the application programs 11*d*-4. Also, the kernel 11*d*-1 may provide an interface for allowing the middleware 11*d*-2, the API 11*d*-3, or the application programs 11*d*-4 to access and control or manage individual components of the electronic device 11.

The middleware 11*d*-2 may serve as a medium through which the kernel 11*d*-1 may communicate with the API 11*d*-3 or the application programs 11*d*-4 to transmit and receive data.

Also, the middleware 11*d*-2 may process one or more task requests received from the application programs 11*d*-4. For example, the middleware 11*d*-2 may assign priorities for using system resources (the bus 11*a*, the processor 11*b*, or the memory 11*c*) of the electronic device 11 to at least one of the application programs 11*d*-4. For example, the middleware 11*d*-2 may perform scheduling or load balancing for the one or more task requests according to the priorities assigned to the at least one application program 11*d*-4.

The API 11*d*-3 is an interface that may control functions that the application programs 11*d*-4 provide at the kernel 11*d*-1 or the middleware 11*d*-2. For example, the API 11*d*-3 may include at least one interface or function (e.g., a command) for file control, window control, video processing, or text control.

The I/O interface 11*e* may, for example, act as an interface that provides a command or data received from a user or an external device to the other component(s) of the electronic device 11. Further, the I/O interface 11*e* may output a command or data received from the other component(s) to the user or the external device.

The display 11*f* may include, for example, a liquid crystal display (LCD), a light emitting diode (LED) display, an organic LED (OLED) display, a microelectromechanical systems (MEMS) display, or an electronic paper display. The display 11*f* may display, for example, various types of content (e.g., text, an image, a video, an icon, or a symbol) to the user. The display 11*f* may include a touch screen and receive, for example, a touch input, a gesture input, a proximity input, or a hovering input through an electronic pen or a user's body part.

The communication interface 11*g* may establish communication between the electronic device 11 and an external device (e.g., a first external electronic device 12, a second external electronic device 13, or a server 14). For example, the communication interface 11*g* may be connected to a network 15 by wireless or wired communication and communicate with the external device (e.g., the second external electronic device 13 or the server 14) over the network 15.

The wireless communication may be conducted using, for example, at least one of long term evolution (LTE), LTE-advanced (LTE-A), code division multiple access (CDMA), wideband CDMA (WCDMA), universal mobile telecommunication system (UNITS), wireless broadband (WiBro), or global system for mobile communications (GSM)), as a cellular communication protocol. The wireless communication may include, for example, short-range communication 16. The short-range communication 16 may be conducted by, for example, at least one of Wi-Fi, Bluetooth (BT), near field communication (NFC), and global navigation satellite system (GNSS). GNSS may include, for example, at least one of global positioning system (GPS), global navigation satellite system (GLONASS), BeiDou navigation satellite system (hereinafter, referred to as 'BeiDou'), and Galileo, the European global satellite-based navigation system. In the present disclosure, the terms 'GPS' and 'GNSS' are interchangeably used with each other. The wired communication may be conducted in conformance to, for example, at least one of universal serial bus (USB), high definition multimedia interface (HDMI), recommended standard 232 (RS-232), and plain old telephone service (POTS). The network 15 may be a communication network, for example, at least one of a computer network (e.g., LAN or WAN), the Internet, and a telephone network.

Each of the first and second external electronic devices 12 and 13 may be of the same type as or a different type from the electronic device 11. According to an embodiment, the server 14 may include a group of one or more servers. According to various embodiments, all or a part of operations performed in the electronic device 11 may be performed in one or more other electronic devices (e.g., the external electronic devices 12 and 13 or the server 14). According to an embodiment, if the electronic device 11 is to perform a function or a service automatically or upon request, the electronic device 11 may request at least a part of functions related to the function or the service to another device (e.g., the external electronic device 12 or 13 or the server 15), instead of performing the function or the service autonomously, or additionally. The other device (e.g., the external electronic device 12 or 13 or the server 15) may execute the requested function or an additional function and provide a result of the function execution to the electronic device 11. The electronic device 11 may provide the requested function or service based on the received result or by additionally processing the received result. For this purpose, for example, cloud computing, distributed computing, or client-server computing may be used.

Figure 2:
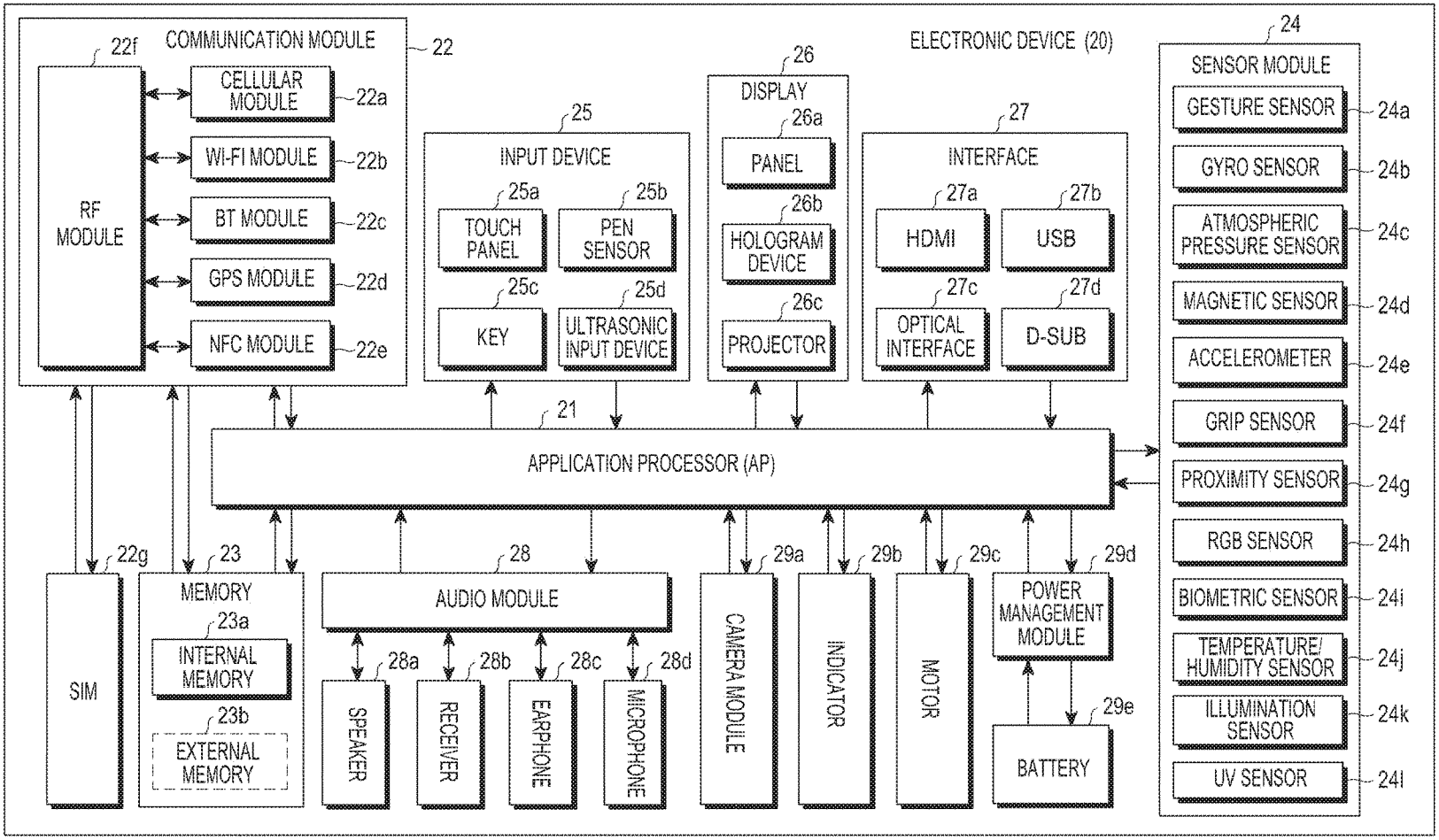
FIG. 2 is a block diagram of an electronic device according to various embodiments of the present disclosure.

FIG. 2 is a block diagram of an electronic device according to various embodiments of the present disclosure.

Referring to FIG. 2, an electronic device 20 may include, for example, the whole or part of the electronic device 11 illustrated in FIG. 1. The electronic device 20 may include at least one processor (e.g., AP) 21, a communication module 22, a subscriber identification module (SIM) 22*g*, a memory 23, a sensor module 24, an input device 25, a display 26, an interface 27, an audio module 28, a camera module 29*a*, a power management module 29*d*, a battery 29*e*, an indicator 29*b*, and a motor 29*c*.

The processor 21 may, for example, control a plurality of hardware or software components that are connected to the processor 21 by executing an OS or an application program and may perform processing or computation of various types of data. The processor 21 may be implemented, for example, as a system on chip (SoC). According to an embodiment, the processor 21 may further include a graphics processing unit (GPU) and/or an image signal processor. The processor 21 may include at least a part (e.g., a cellular module 22*a*) of the components illustrated in FIG. 2. The processor 21 may load a command or data received from at least one of other components (e.g., a non-volatile memory), process the loaded command or data, and store various types of data in the non-volatile memory.

The communication module 22 may have the same configuration as or a similar configuration to the communication interface 11*g* illustrated in FIG. 1. The communication module 22 may include, for example, the cellular module 22*a*, a Wi-Fi module 22*b*, a BT module 22*c*, a GNSS module 22*d* (e.g., a GPS module, a GLONASS module, a BeiDou module, or a Galileo module), an NFC module 22*e*, and a radio frequency (RF) module 22*f*.

The cellular module 22*a* may provide services such as voice call, video call, short message service (SMS), or the Internet through a communication network. According to an embodiment of the present disclosure, the cellular module 22*a* may identify and authenticate the electronic device 20 within a communication network, using the SIM (e.g., a SIM card) 22*g*. According to an embodiment, the cellular module 22*a* may perform at least a part of the functionalities of the processor 21. According to an embodiment, the cellular module 22*a* may include a CP.

Each of the Wi-Fi module 22*b*, the BT module 22*c*, the GNSS module 22*d*, and the NFC module 22*e* may include, for example, a processor that may process data received or transmitted by the respective modules. According to an embodiment, at least a part (e.g., two or more) of the cellular module 22*a*, the Wi-Fi module 22*b*, the BT module 22*c*, the GNSS module 22*d*, and the NFC module 22*e* may be included in a single integrated chip (IC) or IC package.

The RF module 22*f* may transmit and receive communication signals (e.g., RF signals). The RF module 22*f* may include, for example, a transceiver, a power amplifier module (PAM), a frequency filter, a low noise amplifier (LNA), an antenna, or the like. According to an embodiment, at least one of the cellular module 22*a*, the Wi-Fi module 22*b*, the BT module 22*c*, the GNSS module 22*d*, and the NFC module 22*e* may transmit and receive RF signals via a separate RF module.

The SIM 22*g* may include, for example, a card including the SIM and/or an embedded SIM. The SIM 22*g* may include a unique identifier (e.g., integrated circuit card identifier (ICCID)) or subscriber information (e.g., international mobile subscriber identity (IMSI)).

The memory 23 (e.g., the memory 11*c*) may include, for example, an internal memory 23*a* or an external memory 23*b*. The internal memory 23*a* may be at least one of, for example, a volatile memory (e.g., dynamic random access memory (DRAM), static RAM (SRAM), or synchronous DRAM (SDRAM)), and a non-volatile memory (e.g., one time programmable read only memory (OTPROM), PROM, erasable and programmable ROM (EPROM), electrically erasable and programmable ROM (EEPROM), mask ROM, flash ROM, flash memory (e.g., NAND flash memory, or NOR flash memory), a hard drive, and a solid state drive (SSD)).

The external memory 23*b* may further include, for example, a flash drive such as a compact flash (CF) drive, a secure digital (SD), a micro-SD, a mini-SD, an extreme digital (xD), a multi-media card (MMC), or a memory stick. The external memory 23*b* may be operatively and/or physically coupled to the electronic device 20 via various interfaces.

The sensor module 24 may, for example, measure physical quantities or detect operational states associated with the electronic device 20, and convert the measured or detected information into electric signals. The sensor module 24 may include at least one of, for example, a gesture sensor 24*a*, a gyro sensor 24*b*, an atmospheric pressure sensor 24*c*, a magnetic sensor 24*d*, an accelerometer 24*e*, a grip sensor 24*f*, a proximity sensor 24*g*, a color sensor (e.g., a red, green, blue (RGB) sensor) 24*h*, a biometric sensor 24*i*, a temperature/humidity sensor 24*j*, an illumination sensor 24*k*, and an ultra violet (UV) sensor 24*l*. Additionally or alternatively, the sensor module 24 may include, for example, an electrical-nose (E-nose) sensor, an electromyography (EMG) sensor, an electroencephalogram (EEG) sensor, an electrocardiogram (ECG) sensor, an infrared (IR) sensor, an iris sensor, and/or a finger print sensor. The sensor module 24 may further include a control circuit for controlling one or more sensors included therein. According to some embodiments, the electronic device 20 may further include a processor configured to control the sensor module 24, as a part of or separately from the processor 21. Thus, while the processor 21 is in a sleep state, the control circuit may control the sensor module 24.

The input device 25 may include a touch panel 25*a*, a (digital) pen sensor 25*b*, a key 25*c*, or an ultrasonic input device 25*d*. The touch panel 25*a* may operate in at least one of, for example, capacitive, resistive, infrared, and ultrasonic schemes. The touch panel 25*a* may further include a control circuit. The touch panel 25*a* may further include a tactile layer to thereby provide haptic feedback to the user.

The (digital) pen sensor 25*b* may include, for example, a detection sheet which is a part of the touch panel or separately configured from the touch panel. The key 25*c* may include, for example, a physical button, an optical key, or a keypad. The ultrasonic input device 25*d* may be a device configured to identify data by detecting, using a microphone (e.g., a microphone 28*d*), ultrasonic signals generated by an input tool capable of generating the ultrasonic signals.

The display 26 (e.g., the display 110 may include a panel 26*a*, a hologram device 26*b*, or a projector 26*c*. The panel 26*a* may have the same configuration as or a similar configuration to the display 11*f* illustrated in FIG. 1. The panel 26*a* may be configured to be, for example, flexible, transparent, or wearable. The panel 26*a* and the touch panel 25*a* may be implemented as a single module. The hologram device 26*b* may utilize the interference of light waves to provide a three-dimensional image in empty space. The projector 26*c* may provide an image by projecting light on a screen. The screen may be positioned, for example, inside or outside the electronic device 20. According to an embodiment, the display 26 may further include a control circuit for controlling the panel 26*a*, the hologram device 26*b*, or the projector 26*c*.

The interface 27 may include, for example, an HDMI 27*a*, a USB 27*b*, an optical interface 27*c*, or a D-subminiature (D-sub) 27*d*. The interface 27 may be included, for example, in the communication interface 11*g* illustrated in FIG. 1. Additionally or alternatively, the interface 27 may include, for example, a mobile high-definition link (MI-IL) interface, an SD/MMC interface, or an infrared data association (IrDA) interface.

The audio module 28 may convert a sound to an electrical signal, and vice versa. At least a part of the components of the audio module 28 may be included, for example, in the I/O interface 11*d*-3 illustrated in FIG. 1. The audio module 28 may process sound information input into, or output from, for example, a speaker 28*a*, a receiver 28*b*, an earphone 28*c*, or the microphone 28*d*.

The camera module 29*a* may capture, for example, still images and a video. According to an embodiment, the camera module 29*a* may include one or more image sensors (e.g., a front sensor or a rear sensor), a lens, an image signal processor (ISP), or a flash (e.g., an LED or a xenon lamp).

The power management module 29*d* may manage power of the electronic device 20. According to an embodiment, the power management module 29*d* may include a power management IC (PMIC), a charger IC, or a battery fuel gauge. The PMIC may adopt wired and/or wireless charging. The wireless charging may be performed, for example, in a magnetic resonance scheme, a magnetic induction scheme, or an electromagnetic wave scheme, and may use additional circuits for wireless charging, such as a coil loop, a resonance circuit, or a rectifier. The battery fuel gauge may measure, for example, a charge level, a voltage while charging, current, or temperature of the battery 29*e*. The battery 29*e* may include, for example, a rechargeable battery and/or a solar battery.

The indicator 29*b* may indicate specific states of the electronic device 20 or a part of the electronic device 20 (e.g., the processor 21), for example, boot status, message status, or charge status. The motor 29*c* may convert an electrical signal into a mechanical vibration and generate vibrations or a haptic effect. While not shown, the electronic device 20 may include a processing device for supporting mobile TV (e.g., a GPU). The processing device for supporting mobile TV may process media data compliant with, for example, digital multimedia broadcasting (DMB), digital video broadcasting (DVB), or MediaFLO™.

Each of the above-described components of the electronic device may include one or more parts and the name of the component may vary with the type of the electronic device. According to various embodiments, the electronic device may be configured to include at least one of the afore-described components. Some components may be omitted from or added to the electronic device. According to various embodiments, one entity may be configured by combining a part of the components of the electronic device, to thereby perform the same functions of the components prior to the combining.

The term "module" as used herein may include its ordinary meaning including, for example, a unit of one, or a combination of two or more. The term "module" may be used interchangeably with terms such as, for example, unit, logic, logical block, component, or circuit. A "module" may be the smallest unit of an integrated part, or a portion thereof. A "module" may be the smallest unit for performing one or more functions, or a portion thereof. A "module" may be implemented mechanically, or electronically. For example, a "module" may include at least one of a known, or to-be-developed, application-specific IC (ASIC) chip, field-programmable gate array (FPGA) or programmable logic device that perform certain operations.

At least a part of devices (e.g., modules or their functions) or methods (e.g., operations) according to various embodiments of the present disclosure may be implemented as commands stored in a computer-readable storage medium, in the form of a programming module. When the commands are executed by a processor, one or more processors may execute functions corresponding to the commands. The computer-readable storage medium may be, for example, the memory 11*c*.

The computer-readable recording medium may include hard disk, floppy disk, magnetic media (e.g., magnetic tape), optical media (e.g., compact disc ROM (CD-ROM)), digital versatile disc (DVD), magneto-optical media (e.g., floptical disk), hardware devices (e.g., ROM, RAM or flash memory)), and the like. Program instructions may include machine language code that are produced by a compiler or high-level language code that may be executed by a computer using an interpreter. The functionalities of hardware discussed above may be implemented as one or more software modules, and vice versa in order to perform an operation according to various embodiments.

The embodiments disclosed in the present specification are provided for description and understanding of the present disclosure, not limiting the scope of the present disclosure. Accordingly, the scope of the present disclosure should be interpreted as embracing all modifications or various embodiments within the scope of the present disclosure therein.

Figure 3:
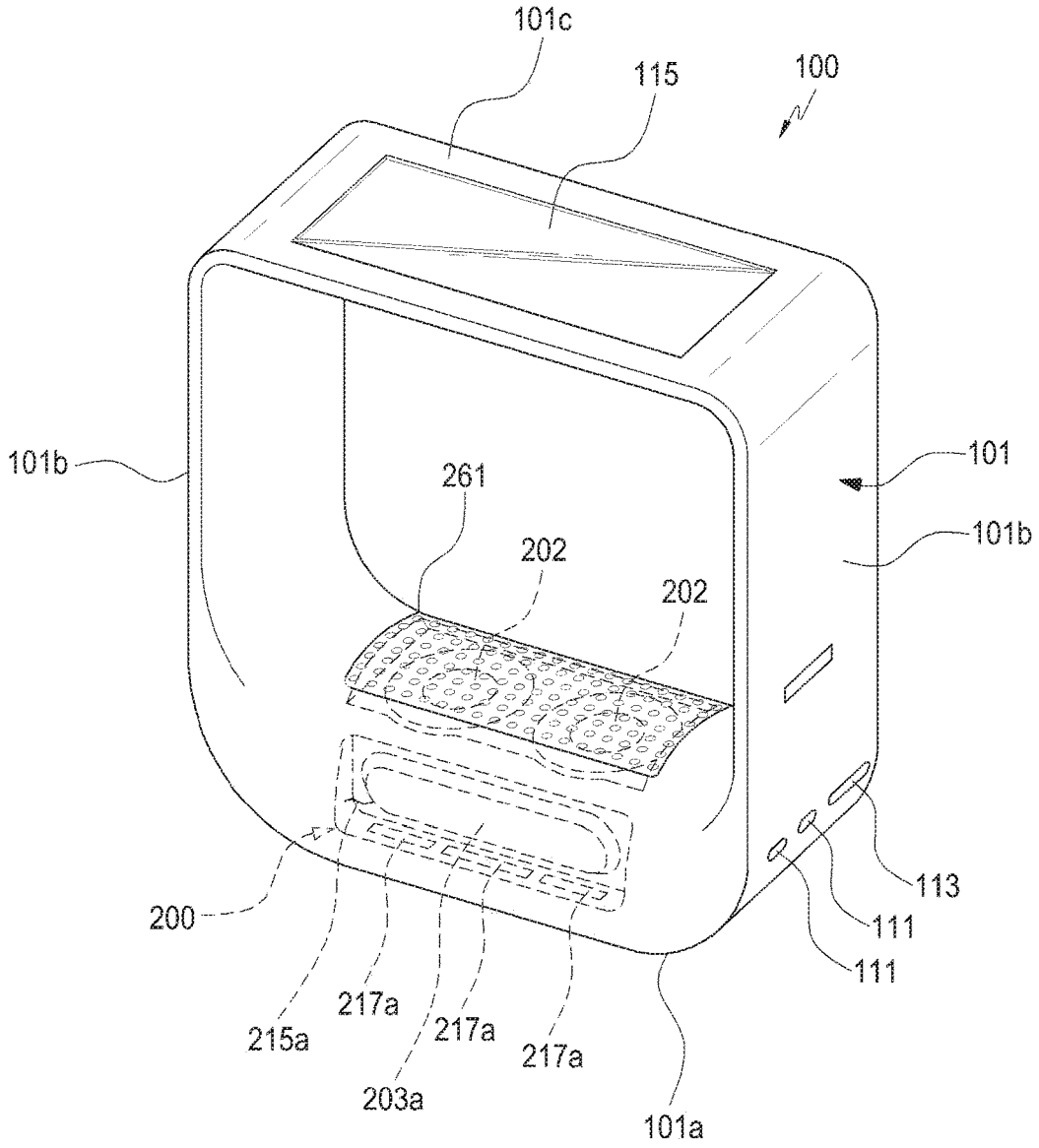
FIG. 3 is a perspective view of an electronic device according to various embodiments of the present disclosure.

FIG. 3 is a perspective view of an electronic device according to various embodiments of the present disclosure.

Referring to FIG. 3, an electronic device 100 may include a speaker device 200 accommodated in a main housing 101.

According to various embodiments of the present disclosure, the main housing 101 may include a base 101*a* for accommodating the speaker device 200, extensions 101*b* extended from both side ends of the base 101*a*, facing each other, and a connector 101*c* that connects top ends of the extensions 101*b* to each other. According to various embodiments, the connector 101*c* may be disposed to face the base 101*a* and include a display panel 115 (e.g., the display 11*f* illustrated in FIG. 1) which is mounted exposed from a top surface of the connector 101*c*. According to various embodiments, the main housing 101 may include connector holes 111 exposed from side surfaces of the main housing 101, for example, outer side surfaces of the extensions 101*b*. The connector holes 111 may provide connectivity to an external device such as an external memory, a power adapter, or a mobile communication terminal. According to various embodiments, the main housing 101 may include at least one button 113. The at least one button 113 may provide functions such as power on/off, volume control, and operation mode switching of the electronic device 100. According to an embodiment, this input function may be executed through the display panel 115 and/or an electronic device equipped with the display panel 115 (e.g., a smart phone). For example, the display panel 115 may be equipped with a touch screen function.

According to various embodiments of the present disclosure, the speaker device 200 may be accommodated in the base 101*a* and include one or more speakers 202, and a passive speaker 203*a* (e.g., a first structure 203*a* and/or a second structure illustrated in FIGS. 4 and 5 as described later) which vibrates along with vibrations accompanying sound output of the speakers 202. The configuration of the speaker device 200 will be described later in greater detail with reference to an embodiment illustrated in FIG. 4 and thus will not be described in detail herein.

According to various embodiments of the present disclosure, the electronic device 100 may be equipped with various circuit devices. For example, the electronic device 100 may include an internal battery (e.g., the battery 29*e* illustrated in FIG. 2) and a power management module (e.g., the power management module 29*d* illustrated in FIG. 2). In an embodiment, the electronic device 100 may include at least one of a memory (e.g., the memory 11*c* illustrated in FIG. 1 and/or the memory 23 illustrated in FIG. 2), an audio module (e.g., the audio module 28 illustrated in FIG. 2), and a communication module (e.g., the communication module 22 illustrated in FIG. 2). For example, the electronic device 100 may reproduce a multimedia file by an application loaded in the memory. Sound information may be provided to the audio module during reproduction of the multimedia file, and the audio module may output a sound signal that operates the speakers 202.

According to various embodiments, the electronic device 100 may receive a multimedia file from an external device connected to the electronic device 100 via a connector hole 111 and reproduce the received multimedia file. In an embodiment, the electronic device 100 may receive a multimedia file from a network or an external device connected to the electronic device 100 via an internal communication module and reproduce the received multimedia file. In some embodiments, the electronic device 100 may be connected simultaneously to various external devices by transmitting and receiving wireless signals through the internal communication module. For example, while communicating with a refrigerator, an air conditioner, a heater, various video devices, a security device (e.g., a door lock), and the like, the electronic device 100 may receive information (e.g., information about an operation state) from each of the external devices, and when needed, output the received information to a user.

For example, if a storage temperature and a preset temperature are different by a predetermined value or larger in the refrigerator, the refrigerator may output an error signal, and the electronic device 100 may receive the error signal and output the error signal audibly, so as to prompt the user to check out the refrigerator. According to various embodiments, the air conditioner may measure an indoor temperature all the time, periodically, or irregularly. When the indoor temperature is beyond an appropriate temperature range, the air conditioner may output a notification signal. Then the electronic device 100 may receive the notification signal and output the received notification signal audibly.

According to various embodiments, when the user hears a sound output from the electronic device 100, the user may execute a command that operates an external device, when needed. This command may be executed, for example, by the user's voice. For example, the electronic device 100 may receive the user's voice and output the user's command as a wireless signal according to the received command, to thereby operate a corresponding external device. In an embodiment, the user's command may be provided to the electronic device 100 through another electronic device (e.g., a smart phone carried by the user), not by voice.

The main housing 101 may further include at least one acoustic recess 215*a*, at least one radiating hole 217*a* and a radiating grill 261.

According to various embodiments, the electronic device 100 may include all or at least a part of the electronic devices 11, 12, 13, and 20 illustrated in FIG. 1 and/or FIG. 2, and thus may provide functions such as communication or multimedia file reproduction.

Figure 4:
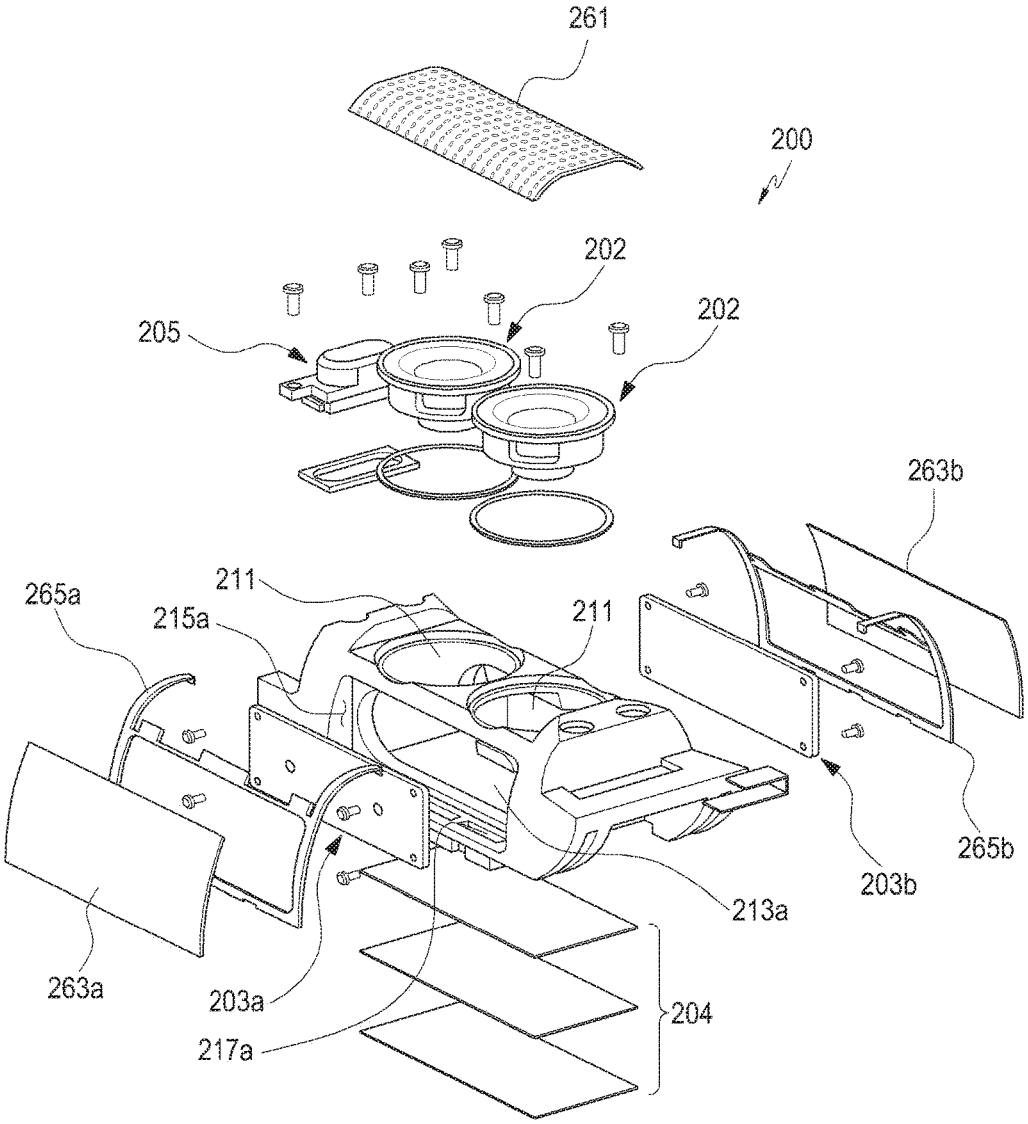
FIG. 4 is an exploded perspective view of a speaker device according to various embodiments of the present disclosure.

FIG. 4 is an exploded perspective view of a speaker device according to various embodiments of the present disclosure.

Figure 5:
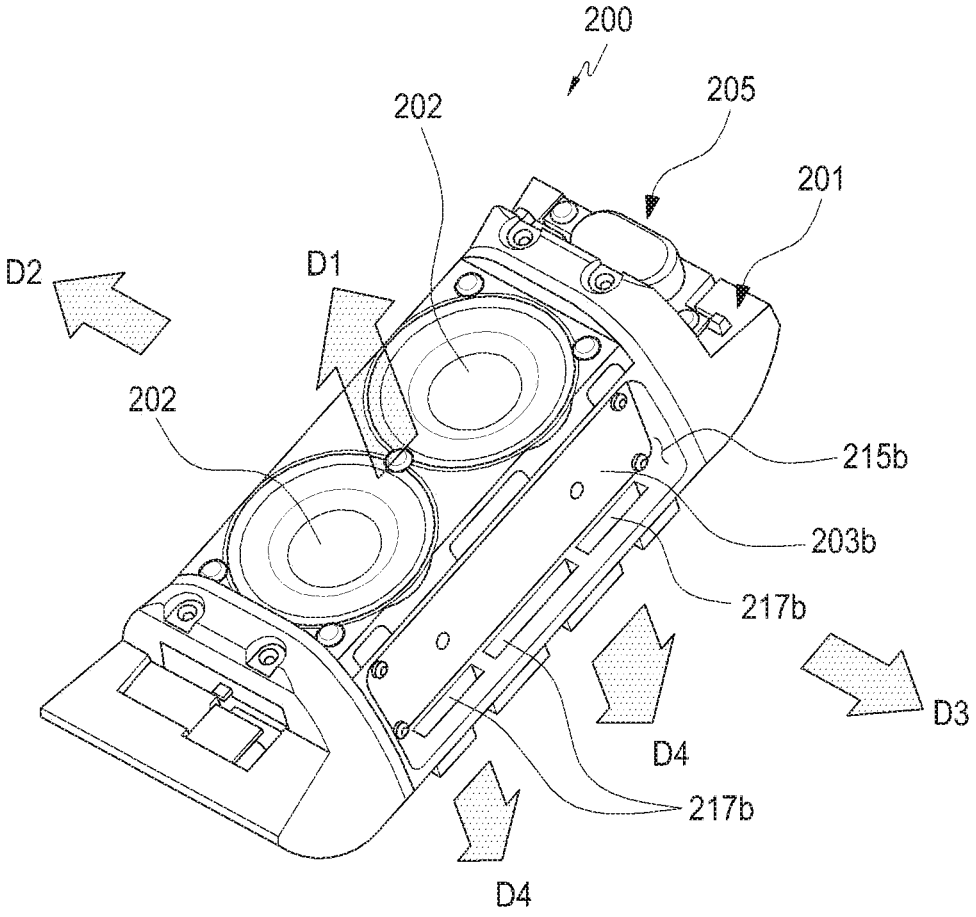
FIG. 5 is an assembled perspective view of a speaker device according to various embodiments of the present disclosure.

FIG. 5 is an assembled perspective view of a speaker device according to various embodiments of the present disclosure.

Referring to FIGS. 4 and 5, the speaker device 200 may include a housing 201, first speakers 202 (e.g., the speakers 202 illustrated in FIG. 3), and the first and second structures 203*a* and 203*b* that vibrate along with vibration of the first speakers 202. It is to be noted that components such as a radiating grill 261 and/or the first and second cover members 263*a* and 263*b* are not shown in FIG. 5 in order to clarify the structure of the speaker device 200.

According to various embodiments of the present disclosure, the housing 201 may include an inner space (e.g., a later-described inner space 319 illustrated in FIG. 6), for example, a resonant space, surrounded by a top surface and a plurality of side surfaces connected to the top surface. For example, the housing 201 may provide a space or surface for mounting various parts of the speaker device 200 therein or thereon, such as the first speakers 202. According to various embodiments, the housing 201 may include one or more first through holes 211 formed in a first direction D1. As the first speakers 202 are mounted in the first through holes 211, at least parts of the first speakers 202 may isolate the inner space from the outside of the housing 201. In an embodiment, a pair of first through holes 211 may be formed in parallel on the top surface of the housing 201.

According to various embodiments, the housing 201 may include the radiating grill 261 mounted on the top surface of the housing 201. For example, the radiating grill 261 includes a plurality of radiating holes, thereby preventing exposure of the speaker(s) 202 to an ambient environment and outputting sound generated by the speaker(s) 202 to the outside. While the radiating grill 261 is attached onto the top surface of the housing 201 in the embodiment, the present disclosure is not limited thereto. According to an embodiment, the radiating grill 261 may be mounted in the base 101*a* of the main housing 101. For example, as far as the radiating grill 261 can output sound generated from the first speaker(s) 202, protecting the first speaker(s) 202, the radiating grill 261 may be attached to any of the housing 201 and/or the base 101*a*.

According to various embodiments, the housing 201 may include one or more through holes 213*a* in different directions from the first direction D1, for example, in a second direction D2 and/or a third direction D3. In an embodiment, a second through hole 213*a* may be formed on each of two different side surfaces of the housing 201, for example, two opposite side surfaces of the housing 201. For example, one of the second through holes 213*a* may be formed in the second direction D2, and the other second through hole 213*a* may be formed in the third direction D3. The first and second structures 203*a* and 203*b* may be mounted as second and third speakers in the respective second through holes 213*a*. At least a part of each of the first and second structures 203*a* and 203*b* may isolate the inner space from the outside of the housing 201. According to an embodiment, as the second through holes 213*a* provide means for mounting the first structure 203*a* and/or the second structure 203*b*, the second through holes 213*a* may form a passage in which at least part of sound output from the speaker device 200 travels.

According to various embodiments of the present disclosure, one or more acoustic recesses 215*a* and 215*b* may be formed on an outer circumferential surface of the housing 201. The acoustic recesses 215*a* and 215*b* may be recessed from the outer circumferential surface of the housing 201 and at least parts of the second through holes 213*a* may be positioned in the acoustic recesses 215*a* and 215*b*. For example, the acoustic recesses 215*a* and 215*b* may be formed respectively on the two side surfaces directed in the second and third directions D2 and D3. In an embodiment, the sound hole(s) 215*a* and/or 215*b* may be closed by the first cover member 263*a* and/or the second cover member 263*b*. To attach and fix the first and second cover members 263*a* and 263*b*, the speaker device 200 may further include sealing members 265*a* and 265*b*. The sealing members 265*a* and 265*b* may include a Poron tape and may be attached around the periphery of the acoustic recess(es) 215*a* and/or 215*b* on the outer circumferential surface of the housing 201. The sealing members 265*a* and 265*b* may include closed loop parts surrounding the peripheries of the acoustic recesses 215*a* and 215*b*. According to an embodiment, the sealing members 265*a* and 265*b* may include parts extended from the closed loop parts, thereby providing means for attaching the radiating grill 261 to the housing 201.

According to various embodiments, the speaker device 200 may further include one or more radiating holes 217*a* and 217*b* extended from the acoustic recesses 215*a* and 215*b*. In an embodiment, the radiating holes 217*a* and 217*b* may penetrate through the housing 201 in a fourth direction D4 opposite to the first direction D1. For example, the acoustic recesses 215*a* and 215*b* may communicate with the outside of the housing 201 through the radiating holes 217*a* and 217*b*.

A bottom surface of the housing 201, for example, a surface of the housing 201 facing the surface of the housing 201 on which the first through holes 211 are formed may be partially opened. For example, the inner space may be exposed at least partially from the bottom surface of the housing 201. According to various embodiments, a third cover member 204 may be mounted on the bottom surface of the housing 201, thereby isolating the inner space from the outside of the housing 201. For example, although the inner space communicates with the outside of the housing 201 through the first and second through holes 211 and 213*a*, at least a part of the first speakers 202, the first and second structures 203*a* and 203*b*, and/or the third cover member 204 may seal or isolate the inner space from the outside of the housing 201.

According to various embodiments of the present disclosure, the first speakers 202 may receive a sound signal and generate sound in the first direction D1 (e.g., upward from the housing 201). For example, each of the first speakers 202 may have a diaphragm and a voice coil in combination and generate first sound by vibrating the diaphragm according to a sound signal provided to the voice coil. The sound generated from the first speakers 202, for example, the first sound may include at least a part of an audible frequency band, for example, the whole audible frequency band. According to various embodiments, sound in a frequency band may have a sound volume approximate to that of original sound, while sound in another frequency band may have a sound volume lower than that of the original sound. For example, sound output from a general speaker device may have a lower volume sound in a low frequency band around 100 Hz than in other frequency bands.

According to various embodiments of the present disclosure, when the first sound is output, the first and second structures 203*a* and 203*b* vibrate along with vibration of the first speakers 202. Thus, the first and second structures 203*a* and 203*b* may act as second and third speakers for generating a second sound and a third sound, respectively. For example, the first structure 203*a* and/or the second structure 203*b* may be a passive component that does not transmit or receive an electrical signal externally. As stated before, the inner space is sealed or isolated from the outside of the housing 201 by the first speakers 202, the first and second structures 203*a* and 203*b*, and the third cover member 204.

According to an embodiment, as the inner space is sealed or isolated, when the first speakers 202 vibrate to generate the first sound, the pressure of the inner space may change. For example, the first structure 203*a* and/or the second structure 203*b* may vibrate according to a variation in the pressure of the inner space, thus generating the second sound and/or the third sound. For example, the first structure 203*a* and/or the second structure 203*b* may function as a passive speaker and generate sound in a part (e.g., a low frequency band around 100 Hz) of the audible frequency band. According to various embodiments, the first structure 203*a* and the second structure 203*b* may generate the second sound and the third sound in the same frequency band, and the frequency band of the second sound and the third sound may include a part of the frequency band of the first sound (e.g., the low frequency band of the audible frequency band). For example, the frequency band of the second sound and the third sound may be narrower than the frequency band of the first sound.

According to various embodiments of the present disclosure, as the first and second structures 203*a* and 203*b* (e.g., the second and third speakers) are mounted on different side surfaces of the housing 201, the first and second structures 203*a* and 203*b* may generate the second sound and the third sound in different directions, for example, in opposite directions. In an embodiment, the first and second structures 203*a* and 203*b* may vibrate according to a change in the pressure of the inner space. For example, if the pressure of the inner space increases, the first structure 203*a* may move in the second direction D2 and the second structure 203*b* may move in the third direction D3. For example, if the pressure of the inner space decreases, the first structure 203*a* may move in the third direction D3 and the second structure 203*b* may move in the second direction D2. According to various embodiments of the present disclosure, the first and second structures 203*a* and 203*b* may generate sound in the same frequency band, while vibrating according to the pressure of the inner space, particularly in directions opposite to each other.

According to various embodiments, the first and second structures 203*a* and 203*b* may move (vibrate) mechanically in directions opposite to each other. For example, the first and second structures 203*a* and 203*b* may move in directions opposite to each other according to the pressure of the inner space. According to various embodiments, the vibrations of the first and second structures 203*a* and 203*b* may counteract each other, thus preventing vibration of the speaker device 200.

According to various embodiments, the speaker device 200 may include a circuit device 205. The circuit device 205 may include at least one of a processor (e.g., the processor 21 in FIG. 2), a memory (e.g., the memory 23 in FIG. 2), an audio circuit (e.g., the audio module 28 in FIG. 2), a power management circuit (e.g., the power management module 29*d* in FIG. 2), and a communication circuit (e.g., the communication module 22 in FIG. 2). According to various embodiments, the audio circuit may convert sound information received from the processor or the memory to an electrical signal and provide the electrical signal to the first speakers 202. According to various embodiments, the first speakers 202 may generate sound by vibrating according to the signal received from the audio circuit. In an embodiment, the processor or the memory may reproduce a multimedia file received through the communication circuit and provide an electrical signal based on sound information to the audio circuit. In another embodiment, the communication circuit may receive information about an operation state of an external device such as a home appliance and provide the received information to the processor.

Figure 6:
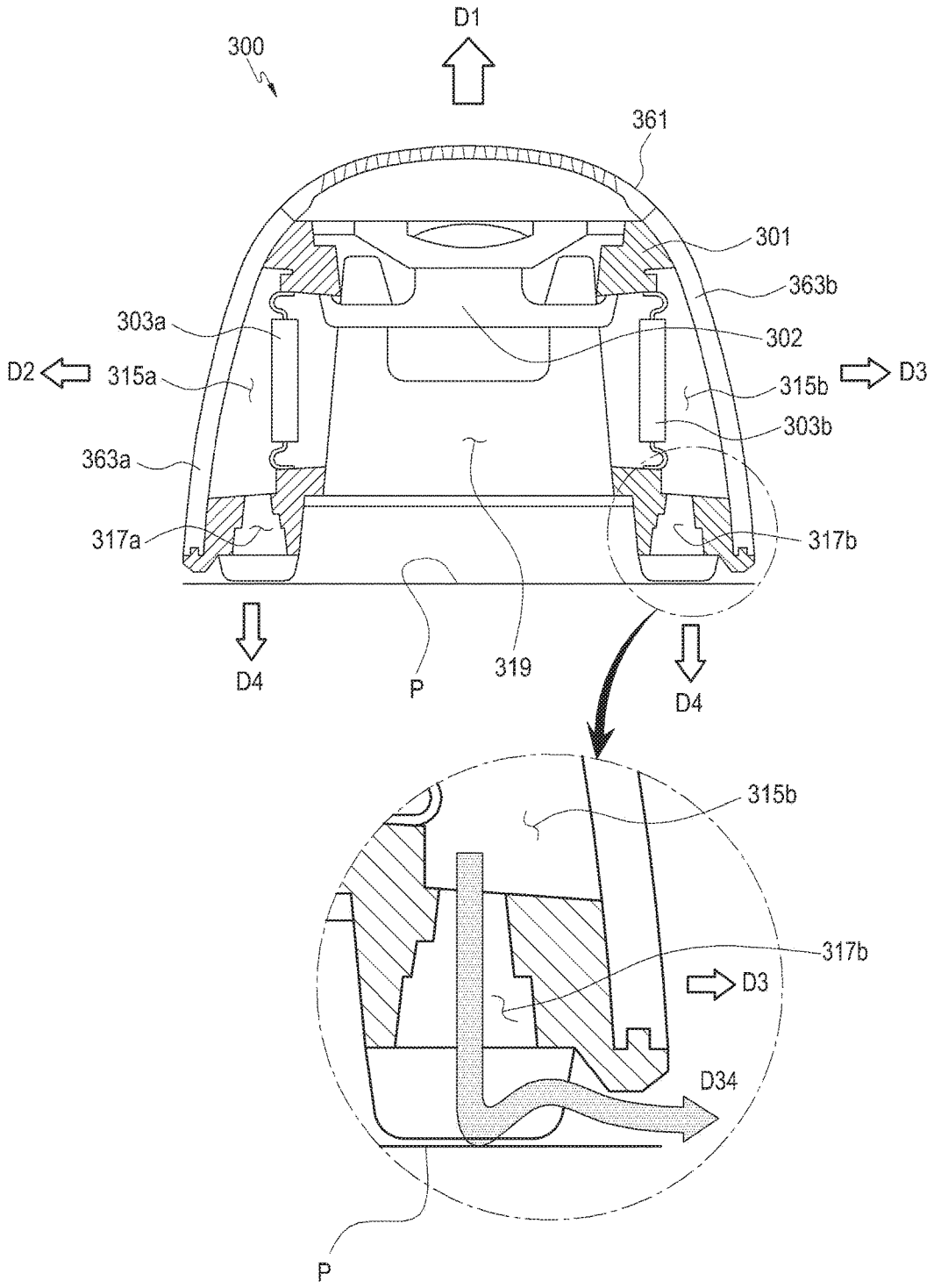
FIG. 6 illustrates a sound radiation passage in a speaker device according to various embodiments of the present disclosure.

FIG. 6 illustrates sound radiation paths in a speaker device according to various embodiments of the present disclosure.

It is to be noted that a structure similar to in the foregoing embodiments or a structure readily understood from the foregoing embodiments will not be described in detail in describing the embodiment of the present disclosure.

Referring to FIG. 6, a speaker device 300 (e.g., the speaker device 200 in FIG. 4) may include a first speaker 302 (e.g., a speaker 202 in FIG. 4) mounted in a housing 301 (e.g., the housing 201 in FIG. 4), a second speaker 303*a* (e.g., the first structure 203*a* in FIG. 4), and a third speaker 303*b* (e.g., the second structure 203*b* in FIG. 4). According to an embodiment, the first speaker 302 may generate first sound by receiving an electrical signal from an audio circuit and thus vibrating. The pressure of an inner space 319 in the housing 301 may change according to the vibration of the first speaker 302. For example, as the second and third speakers 303*a* and 303*b* vibrate due to a change in the pressure of the inner space 319, the second and third speakers 303*a* and 303*b* may generate a second sound and a third sound, respectively. For example, the second and third speakers 303*a* and 303*b* may be passive components that vibrate according to a change in the pressure of the inner space 319 without transmitting or receiving electrical signals externally.

According to various embodiments, the second speaker 303*a* may form a first sound passage together with at least a part of the housing 301. For example, the second speaker 303*a* may form the first sound passage connected to the outside of the housing 301 through a first acoustic recess 315*a* formed on the outer surface of the housing 301 and one or more first radiating holes 317*a* extended from the first acoustic recess 315*a*. For example, the first sound passage may communicate with the outside of the housing 301 through the first radiating holes 317*a*. According to an embodiment, the first acoustic recess 315*a* may be isolated from the outside of the housing 301 by a first cover member 363*a*.

According to various embodiments, the third speaker 303*b* may form a second sound passage together with at least a part of the housing 301. For example, the third speaker 303*b* may form the second sound passage connected to the outside of the housing 301 through a second acoustic recess 315*b* formed on the outer surface of the housing 301 and one or more second radiating holes 317*b* extended from the second acoustic recess 315*b*. For example, the second sound passage may communicate with the outside of the housing 301 through the second radiating holes 317*b*. According to an embodiment, the second acoustic recess 315*b* may be isolated from the outside of the housing 301 by a second cover member 363*b*.

In an embodiment, the first and second sound paths may be configured to communicate with each other. For example, if the speaker device 300 (e.g., the speaker device 200 illustrated in FIG. 4) is placed on a plane P, the bottom surface of the housing 301 may face the plane P, apart from the plane P, and the first and second sound paths, for example, the first and second radiating holes 317*a* and 317*b* may communicate with each other under the housing 301.

According to various embodiments, the bandwidths of sound generated from the second and third speakers 303*a* and 303*b*, for example, the bandwidths of the second sound and the third sound may be substantially identical. In an embodiment, the second and third speakers 303*a* and 303*b* may be disposed on opposite side surfaces of the housing 301 in order to radiate the second sound and the third sound, respectively. The second sound and the third sound may be output to the outside of the housing 301 (e.g., in the fourth direction D4) through the first and second acoustic recesses 315*a* and 315*b* and then the first and second radiating holes 317*a* and 317*b*. The second sound and the third sound may be output in side directions of the housing 301, for example, in the second and third directions D2 and D3, respectively (e.g., in a passage D34 in FIG. 6), directly and/or after being reflected from the plane P.

In an embodiment, each of the second and third speakers 303*a* and 303*b* vibrates in an opposite direction to the other speaker, thereby mitigating and/or preventing mechanical vibration of the speaker device 300. For example, since the second and third speakers 303*a* and 303*b* suppress vibration of the speaker device 300 placed on the plane P, the second and third speakers 303*a* and 303*b* may suppress noise other than sound generated by the first speaker 302, the second speaker 303*a*, and/or the third speaker 303*b*. According to various embodiments, the second and third speakers 303*a* and 303*b* may vibrate at the same speed with the same displacement in directions opposite to each other.

The first speaker 302 may vibrate by receiving an electrical signal from the audio circuit (e.g., the audio module 28 in FIG. 2) and thus output sound in at least a part of the audible frequency band, for example, in the whole audible frequency band. The second and third speakers 303*a* and 303*b* may output sound in a part of the audible frequency band, for example, in a low frequency band around 100 Hz by vibrating according to a change in the pressure of the inner space 319. According to various embodiments, the first speaker 302 may output sound in a band including the audible frequency band. In an embodiment, the low-frequency-band sound output from the first speaker 302 may have a lower pressure than sound in other frequency bands according to the spatial characteristics of the speaker device 300 and/or the electronic device (the electronic device 100 illustrated in FIG. 3). According to an embodiment, since the second and third speakers 303*a* and 303*b* output sound in the low frequency band, the second and third speakers 303*a* and 303*b* may supplement the low-frequency-band sound of the first speaker 302.

The above-described speaker device may suppress interference between sounds generated from the first, second, and third speakers 302, 303*a*, and 303*b* because the first, second, and third speakers 302, 303*a*, and 303*b* have different radiation areas and/or radiation directions (e.g., the first direction D1 for the first speaker 302 through a radiating grill 361, the second direction D2 for the second speaker 303*a*, and the third direction D3 for the third speaker 303*b*). For example, the speaker device 300 may output sound uniformly in a frequency band other than the low frequency band in the audible frequency band. According to various embodiments, as the mechanical vibrations of the second and third speakers 303*a* and 303*b* counteract each other, noise may be prevented, which might otherwise be made by vibration of the speaker device 300 placed on the plane P.

Figure 7:
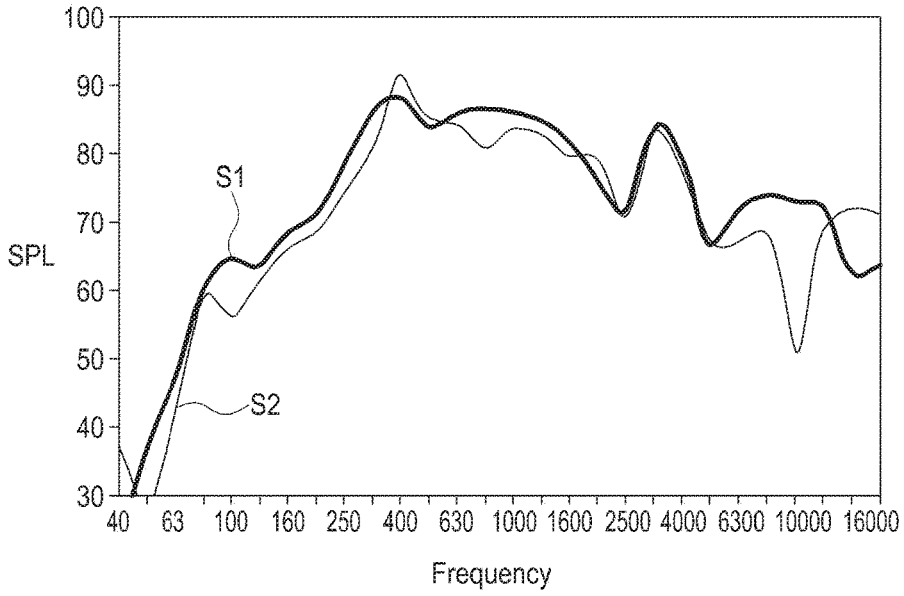
FIGS. 7 and 8 are graphs illustrating property measurements of a speaker device according to various embodiments of the present disclosure.
Figure 8:
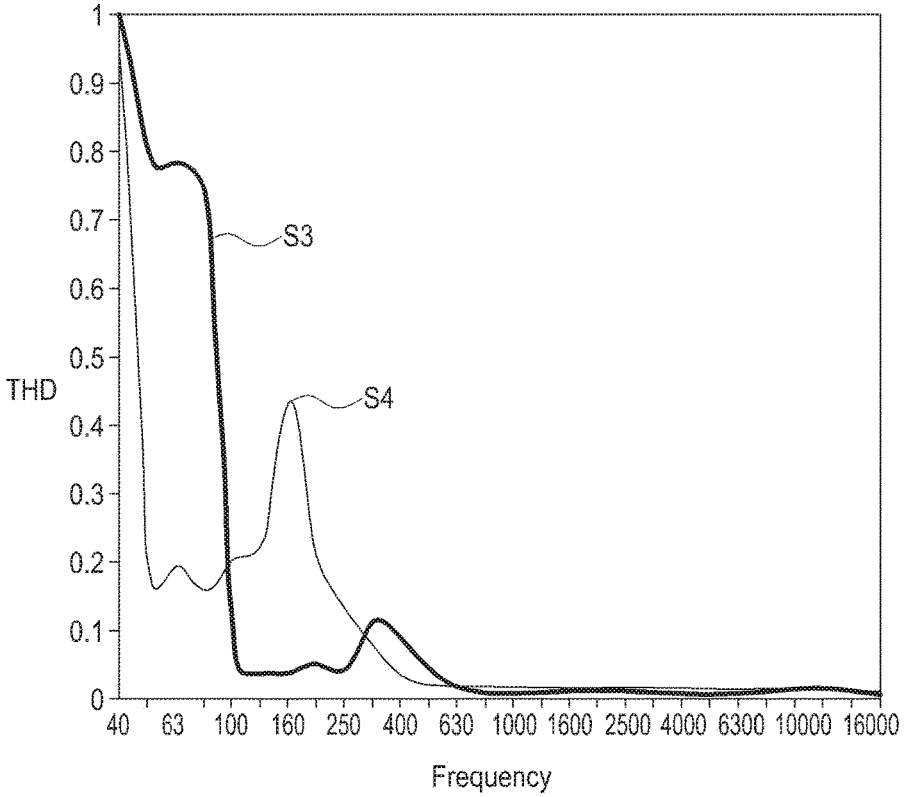

FIGS. 7 and 8 are graphs illustrating measurements of characteristics of a speaker device according to various embodiments of the present disclosure.

Referring to FIG. 7, a reference character 51 denotes the sound pressure levels (SPLs) of outputs of a speaker device according to various embodiments of the present disclosure (e.g., the speaker devices 200 and 300 illustrated respectively in FIGS. 4 and 6), and a reference character S2 denotes SPL measurements of outputs of a general speaker device. Referring to FIG. 7, it may be noted that the speaker device according to various embodiments of the present disclosure has improved SPLs across the whole frequency band of sound output from the speaker device, although different according to frequency bands. Furthermore, it may be noted that the SPL of the low frequency band (e.g., a frequency band around 100 Hz) difficult to improve in the general speaker device has been improved by about 5 dB (8.3%) in the speaker device according to various embodiments of the present disclosure.

Referring to FIG. 8, a reference character S3 denotes total harmonic distortions (THDs) of the speaker device according to various embodiments of the present disclosure (e.g., the speaker devices 200 and 300 illustrated in FIGS. 4 and 6, respectively), and a reference character S4 denotes THD measurements of the general speaker device. Referring to FIG. 8, it may be noted that the speaker device has a THD of about 43% in the audible frequency band, whereas the speaker device according to various embodiments of the present disclosure has a THD of about 10% in the audible frequency band.

As described above, the speaker device according to various embodiments of the present disclosure (e.g., the speaker devices 200 and 300 illustrated in FIGS. 4 and 6, respectively) and/or an electronic device including the speaker device (e.g., the electronic device 100 illustrated in FIG. 3) may provide improved sound quality by improving the SPL or the THD. According to various embodiments, since passive speakers that output sound in a low frequency band (e.g., the first and second structures 203*a* and 203*b* illustrated in FIG. 4 and/or the second and third speakers 303*a* and 303*b* illustrated in FIG. 6) counteract their each other's mechanical vibrations, they may suppress vibration of the speaker device (and/or the electronic device) placed on a plane. For example, generation of noise other than sound generated from the afore-described speaker (e.g., the speakers 202 in FIG. 4), the first and second structures (e.g., the first and second structures 203*a* and 203*b* in FIG. 4), and the first, second, and/or third speaker (the first, second, and/or third speaker 302, 303*a*, and/or 303*b* in FIG. 6) may be suppressed. For example, even though the housing of the speaker device is designed to be lightweight, the vibration force of the passive speakers may suppress vibration of the speaker device on the plane.

Figure 9:
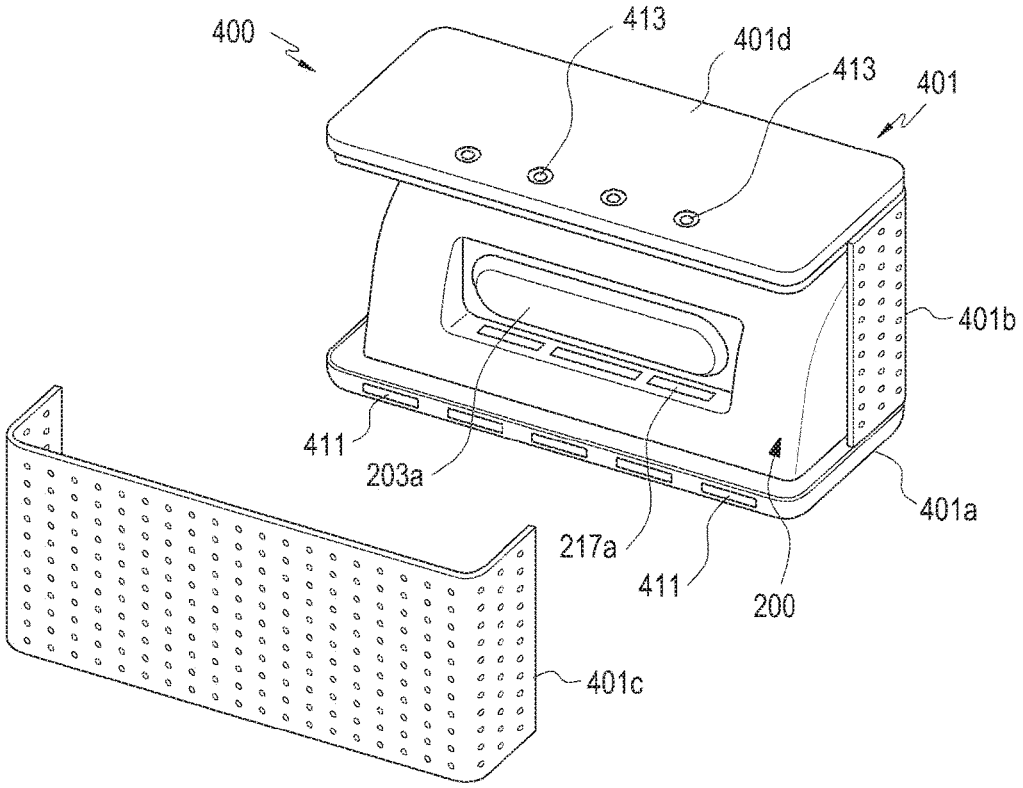
FIG. 9 is an exploded perspective view of another embodiment of a speaker device according to various embodiments of the present disclosure.

FIG. 9 is a perspective view of an electronic device according to another embodiment of the present disclosure.

The following description is given with the appreciation that the same reference numerals as used in the foregoing embodiments are assigned to components similar to their counterparts in the foregoing embodiments or components readily understood from the foregoing embodiments and the components are not described in detail.

Referring to FIG. 9, an electronic device 400 may include a housing 401 for accommodating the afore-described speaker device 200 and may be configured in various manners.

According to various embodiments of the present disclosure, the housing 401 may include a bottom member 401*a*, side members 401*b* and 401*c*, and/or a top member 401*d*. According to various embodiments, the bottom member 401*a* may provide a passage in which sound generated from the second speaker 203*a* and/or the third speaker travels and is output. For example, sound generated from the second speaker 203*a* may be introduced into the bottom member 401*a* through the radiating holes 217*a* and output to the outside of the housing 401 through one or more sound outlet holes 411 formed in the bottom member 401*a*. According to various embodiments, the speaker device 200 may be fabricated separately and assembled with the bottom member 401*a*. When the speaker device 200 is assembled with the bottom member 401*a*, the radiating holes 217*a* may communicate with the inner space of the bottom member 401*a*.

According to various embodiments, the side members 401*b* and 401*c* may be combined, facing each other. The side members 401*b* and 401*c* may be extended in a height direction (in a height direction from the configuration shown in FIG. 9) between the bottom member 401*a* and the top member 401*d*. While not denoted by a reference numeral, each of the side members 401*b* and 401*c* may include a plurality of through holes, and each of the through holes may output sound generated from the first speaker(s) (e.g., the speakers 202 illustrated in FIG. 4) to the outside of the housing 401.

According to various embodiments, a space in which the second speaker 203*a* is mounted (e.g., the acoustic recess 215*a* in FIG. 4) may be isolated from a passage in which sound generated from the first speaker (e.g., the first speakers 202 in FIG. 4) travels. For example, sound generated from the first speaker may be output to the outside through the through holes formed in the side members 401*b* and 401*c*, and sound generated from the second speaker 203*a* may be output to the outside through the bottom member 401*a*. While the second speaker 203*a* is shown in FIG. 9 as exposed to a space formed (and/or surrounded) by the side members 401*b* and 401*c*, for simplicity of description, the present disclosure is not limited to the specific configuration.

According to various embodiments, the top member 401*d* may form the top (or top surface) of the housing 401 according to various embodiments, and may be combined with the bottom member 401*a* by means of the side members 401*b* and 401*c*. The top member 401*d* may include various circuit devices, for example, the processor 21, the communication module 22, the memory 23, the input device 25, the interface 27, the audio module 28, the indicator 29*b*, the power management module 29*d*, and/or the battery 29*e* illustrated in FIG. 2. The above circuit devices may be appropriately distributed and disposed in the bottom and top members 401*a* and 401*d*. An input device installed in the electronic device 400 may include keys 413 (e.g., the key 25*c* in FIG. 2) disposed on the top surface of the top member 401*d*. According to various embodiments, the input device may include a display device in which a mechanical key (e.g., a dome switch and a tact switch), a touch pad, and/or a touch panel is integrated.

As described above, an electronic device according to various embodiments of the present disclosure may include a housing including an inner space and at least one through hole formed in a first direction, at least one speaker disposed in the inner space, directed to the at least one through hole, a first structure disposed in the inner space, directed in a second direction different from the first direction, for vibrating along with vibration of the speaker generated when the speaker outputs first sound, and forming a first sound passage together with a part of the housing, and a second structure disposed in the inner space, directed in a third direction different from the first and second directions, for vibrating along with vibration of the speaker generated when the speaker outputs the first sound, and forming a second sound passage together with another part of the housing. Each of the first and second sound passages may communicate with the outside of the housing in a direction different from the first direction.

According to various embodiments, the first structure and/or the second structure may be a passive component that does not transmit or receive electrical signals to or from the outside.

According to various embodiments, the first structure and the second structure may generate a second sound and a third sound, respectively by vibrating according to a change in inner pressure of the housing caused by output of the first sound from the speaker.

According to various embodiments, the first and second sound passages may be configured to communicate with each other.

According to various embodiments, the housing may further include at least one other through hole formed in a direction different from the first direction.

According to various embodiments, the first sound passage and/or the second sound passage may be disposed to communicate with the outside of the housing through at least a part of the at least one other through hole.

According to various embodiments, the first structure may generate the second sound by vibrating along with vibration of the speaker generated when the speaker outputs the first sound, and the second structure may generate the third sound by vibrating along with vibration of the speaker generated when the speaker outputs the first sound.

According to various embodiments, the first sound may have a wider frequency bandwidth than the second sound and/or the third sound.

According to various embodiments, the frequency bandwidth of the second sound may be substantially equal to the frequency bandwidth of the third sound.

According to various embodiments, the second direction and the third direction may be opposite to each other on the housing.

According to various embodiments, the electronic device may further include a main housing for accommodating at least the housing, a display panel mounted to be exposed from a top surface of the main housing, at least one connector hole exposed from an outer surface of the main housing, an audio module connected to the at least one speaker, and a communication module for transmitting and receiving wireless signals.

According to various embodiments of the present disclosure, a speaker device may include a housing forming an inner space, a first speaker mounted in the housing, for receiving a sound signal and generating first sound in a first direction, a second speaker mounted in the housing, for generating second sound in a second direction by vibrating according to a change in pressure of the inner space caused by operation of the first speaker, and a third speaker mounted in the housing, for generating third sound in a third direction by vibrating according to the change in the pressure of the inner space caused by the operation of the first speaker. The second and third speakers may be mounted opposite to each other.

According to various embodiments, the speaker device may further include an acoustic recess formed on at least one side surface of the housing, for providing a travel passage for at least one of the second sound and the third sound, and a radiating hole extended from the acoustic recess. The radiating hole may penetrate through the housing in a fourth direction opposite to the first direction.

According to various embodiments, the speaker device may further include a sealing member attached around the acoustic recess on an outer circumferential surface of the housing, and a cover member attached to the sealing member, for closing the acoustic recess.

According to various embodiments, the speaker device may further include a radiating grill having a plurality of radiating holes and attached onto a top surface of the housing. The radiating grill may output the first sound to the outside of the housing.

According to various embodiments, the first speaker may be mounted to be directed upward from the housing, and the second and third speakers may be mounted to be directed in two different side directions of the housing.

According to various embodiments, the second and third speakers may generate sound in the same frequency band.

According to various embodiments, frequency bands of the second sound and the third sound may be a part of a frequency band of the first sound.

According to various embodiments, the speaker device may further include a plurality of through holes formed in the housing, and each of the first, second, and third speakers may be mounted in one of the through holes.

According to various embodiments, the inner space may be isolated from the outside of the housing by at least a part of each of the first, second, and third speakers.

As is apparent from the foregoing description, a speaker device and an electronic device including the speaker device according to various embodiments of the present disclosure may suppress vibration of the speaker, because a pair of passive speakers are disposed in opposite directions to each other and thus counteract their each other's vibrations. According to various embodiments, as the vibration of the speaker device is suppressed by operation of the passive speakers, sound in a low frequency band may be reinforced by means of the passive speakers. According to various embodiments, ability to regenerate sound in each frequency band may be improved by separating the sound radiation area of a speaker that generates sound in the whole audible frequency band from the sound radiation areas of the passive speakers that generate sound in the low frequency band. Furthermore, a passage in which low-frequency-band sound is output may be designed freely by use of a duct structure in consideration of the shape and size of the speaker device and/or the electronic device.

While it has been described in the specific embodiments of the present disclosure that the acoustic input module is configured to include one control module and a pair of transducers, by way of example, the present disclosure is not limited thereto. For example, an electronic device according to various embodiments of the present disclosure may include an acoustic input module having one control module and three or more transducers. Thus, the number of transducers may be appropriately determined according to the specification of an acoustic input module required for the electronic device.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing including an inner space and at least one through hole formed in a first direction;

acoustic recesses formed on both side surface of the housing and recessed from an outer surface of the housing, respectively;

at least one speaker disposed in the inner space, and directed toward the at least one through hole;

a first structure disposed in the inner space, directed in a second direction different from the first direction, and configured to vibrate along with vibration of the speaker generated when the speaker outputs a first sound, and forms a first sound passage including one of the acoustic recesses;

a second structure disposed in the inner space, directed in a third direction different from the first direction and the second direction, and configured to vibrate along with vibration of the speaker generated when the speaker outputs the first sound, and forms a second sound passage including another of the acoustic recesses; and radiating holes extended from one or more of the acoustic recesses and penetrating through the housing in a fourth direction opposite to the first direction, respectively, wherein each of the first sound passage and the second sound passage communicates with an outside of the housing in a direction different from the first direction.

2. The electronic device of claim 1, wherein at least one of the first structure or the second structure is a passive component that does not transmit or receive electrical signals to or from the outside.

3. The electronic device of claim 1, wherein the first structure and the second structure generate a second sound and a third sound, respectively, by vibrating according to a change in inner pressure of the housing caused by the outputting of the first sound from the speaker.

4. The electronic device of claim 1, wherein the first sound passage and the second sound passage are configured to communicate with each other.

5. The electronic device of claim 1, wherein the first structure is further configured to generate a second sound by vibrating along with vibration of the speaker generated when the speaker outputs the first sound, and wherein the second structure is further configured to generate a third sound by vibrating along with vibration of the speaker generated when the speaker outputs the first sound.

6. The electronic device of claim 5, wherein the first sound has a wider frequency bandwidth than at least one of the second sound or the third sound.

7. The electronic device of claim 5, wherein a frequency bandwidth of the second sound is substantially equal to a frequency bandwidth of the third sound.

8. The electronic device of claim 1, wherein the second direction and the third direction are opposite to each other on the housing.

9. The electronic device of claim 1, further comprising:

a main housing configured to accommodate at least the housing;

a display panel mounted to be exposed from a top surface of the main housing;

at least one connector hole exposed from an outer surface of the main housing;

an audio device connected to the at least one speaker; and a transceiver configured to transmit and receive wireless signals.

10. A speaker device comprising:

a housing forming an inner space;

a first speaker mounted in the housing, and configured to: receive a sound signal, and generate a first sound in a first direction;

a second speaker mounted in the housing, and configured to generate a second sound in a second direction by vibrating according to a change in pressure of the inner space caused by operation of the first speaker;

a third speaker mounted in the housing, and configured to generate a third sound in a third direction by vibrating according to the change in the pressure of the inner space caused by the operation of the first speaker;

acoustic recesses formed on both side surface of the housing and recessed from an outer surface of the housing, respectively, and configured to provide a travel passage for at least one of the second sound or the third sound; and radiating holes extended from one or more of the acoustic recesses and penetrating through the housing in a fourth direction opposite to the first direction, respectively, wherein the second speaker and the third speaker are mounted opposite to each other.

11. The speaker device of claim 10, further comprising:

a sealing member attached around the acoustic recess on an outer circumferential surface of the housing; and a cover member attached to the sealing member, for closing the acoustic recess.

12. The speaker device of claim 10, further comprising:

a radiating grill having a plurality of radiating holes and attached onto a top surface of the housing, wherein the radiating grill is configured to output the first sound to the outside of the housing.

13. The speaker device of claim 10, wherein the first speaker is mounted to be directed upward from the housing, and wherein the second speaker and the third speaker are mounted to be directed in two different side directions of the housing.

14. The speaker device of claim 13, wherein the second speaker and the third speaker generate sound in a same frequency band.

15. The speaker device of claim 13, wherein frequency bands of the second sound and the third sound are a part of a frequency band of the first sound.

16. The speaker device of claim 10, further comprising:

a plurality of through holes formed in the housing, wherein each of the first speaker, the second speaker, and the third speaker is mounted in one of the through holes.

17. The speaker device of claim 16, wherein the inner space is isolated from the outside of the housing by at least a part of each of the first speaker, the second speaker, and the third speaker.

* * * * *